United States Patent [19]

Gakenholz

[11] 3,936,243

[45] Feb. 3, 1976

[54] FUEL PUMP

[75] Inventor: Werner Gakenholz, Bietigheim-Wurtt., Germany

[73] Assignee: SWF-Spezialfabrik fur Autozubehor Gustav Rau GmbH, Germany

[22] Filed: June 24, 1974

[21] Appl. No.: 482,240

[30] Foreign Application Priority Data

July 28, 1973 Germany ..... 2338395

[52] U.S. Cl. ..... 417/423 R; 415/53 T; 417/366; 417/372

[51] Int. Cl.² ..... F04B 35/04

[58] Field of Search ..... 417/423 R, 366, 372; 415/53 T

[56] References Cited

UNITED STATES PATENTS

| | | | |
|---|---|---|---|
| 975,532 | 11/1910 | Keller | 417/366 |
| 1,114,727 | 10/1914 | Breeze | 417/366 |
| 2,704,516 | 3/1955 | Mock et al. | 417/366 |
| 2,824,520 | 2/1958 | Bartels | 417/423 R |
| 3,073,248 | 1/1963 | Bartels | 417/423 R |
| 3,398,687 | 8/1968 | Yoshikawa | 417/366 |
| 3,418,991 | 12/1968 | Schulz et al. | 417/366 |
| 3,666,381 | 5/1972 | Ulm et al. | 417/423 R |
| 3,836,291 | 9/1974 | Bottcher | 417/423 R |

*Primary Examiner*—C. J. Husar
*Attorney, Agent, or Firm*—McGlew and Tuttle

[57] ABSTRACT

A fuel pump, comprises an electric motor mounted in a tubular housing which is formed with a tapered portion at the take-in side, and an impeller which is mounted adjacent the tapered portion of the housing on the armature shaft of the motor for rotation therewith. A disc-shaped wall concentrical of the armature shaft separates the impeller from the motor space and is formed, at its circumference, with a channel-shaped annular duct open toward the periphery of the impeller. The radially extending impeller blades are thereby enclosed between the tapered portion of the housing and the disc-shaped wall, and the fuel is guided radially into the annular duct. The inside cross-section of the duct is appropriately increasing along the circumference so that the fuel speed is reduced with minimum losses of energy and passes through apertures in the annular duct to the inside periphery of the motor space to which it is urged due to centrifugal forces and along which it is guided by longitudinal ribs prior to passing to the outlet. To improve the efficiency of the impeller, the blades are covered by an annular wall at the side remote from the tapered portion of the housing.

3 Claims, 2 Drawing Figures

FUEL PUMP

BACKGROUND OF THE INVENTION

1. Field of the Invention

This invention relates in general to pumps for liquids and, in particular, to a new and useful pump having an improved efficiency and particularly suitable as a fuel pump for use in motor vehicles.

2. Description of the Prior Art

Fuel pumps, constructed according to the so-called "side duct principle" are known, and such pumps are only able to supply small quantities of fuel under low pressure. Such pumps, for example, deliver only a few literes of fuel per minute at only some tenths atmosphere pressure. The efficiency of such known delivery pumps is below 10%, and is accordingly insufficient.

SUMMARY OF THE INVENTION

According to the present invention, a pump for liquids comprises an electric motor mounted concentrically in a tubular housing, an impeller with radial blades mounted on the armature shaft of the motor, wherein the housing tapers on the side of the impeller remote from the armature and wherein means are provided for forming an annular duct adjacent the circumference of the impeller.

Such a delivery pump can operate with an impeller of a small diameter, so that the diameter of the delivery pump itself can be made small. The delivery pump, when being used as a gasoline pump, can accordingly be inserted through an opening in a gasoline tank of, for example, a motor vehicle, and arranged in said tank.

In an embodiment of the invention, in order to prevent or inhibit return flow from the annular duct to the impeller, the ends of the blades of the impeller are on the side facing the armature, and are provided with an annular wall located perpendicularly to the armature shaft. By this means, large build-up of pressure behind the impeller is avoided, and the axial thrust is kept low.

In a preferred embodiment of the invention, the annular duct forming means are provided by substantially annular duct body supported on the housing, said body comprising an annular plate member arranged centrally relative to the armature shaft, and a duct portion adjoining the outer edge of the plate member and having a U-shaped cross-section, the plate member joining the end of one U shank at right angles thereto, while the other shank is of a greater length than the first shank and the connecting portion between the shanks is provided with apertures.

In order to minimize losses of kinetic energy in the annular duct, the present invention is further characterized in that the length of the first shank, measured from the end of the first shank to the inside of the connecting piece, is calculated so that it increases from zero to an end value over a small portion of the circumference of the annular duct body, and in that the space between the two shanks is calculated so that it has a minimum value over the said portion of the circumference and then increases over the remainder of the circumference to a maximum value. The high speed of the fuel is thus reduced with very low losses.

According to a further preferred embodiment of the present invention, the annular duct body is provided with struts or ribs on the side facing the armature which ribs extend in the longitudinal direction of the pump and are mounted at the level of the apertures in the connecting apertures and support the magnetic system of the electric motor with their free ends in such a manner that fuel is conducted between the magnetic system and the housing. The flow is thus kept remote from the electric motor to a considerable extent.

Accordingly, it is an object of the present invention to provide a pump which has improved efficiency and, at the same time, is relatively simple in construction.

Another object of the invention is to provide a pump for liquids comprising an electric motor mounted concentrically in a tubular housing having a tapered portion at the inlet side, an impeller mounted on the armature shaft of the motor adjacent the tapered portion of the housing and having radially extending blades between which the liquid is taken up to the periphery of the propeller, an annular duct provided at this periphery through which the liquid passes and which is appropriately shaped to reduce the speed of the liquid while minimizing the losses of energy, and ribs extending longitudinally at the inner periphery of the housing for supporting the magnetic system of the motor and guiding the circulating liquid along the outside of the motor.

A further object of the invention is to provide the annular duct in the form of a substantially annular body concentrical of the armature shaft and formed at its periphery with a channel-shaped duct open toward the propeller circumference and having a varying cross-section such that the height of one shank of the U-section increases from zero to a predetermined value over a small portion of the circumference of the duct and then remains constant while the other shank of the U-section is of a greater height which is constant and the web portion between the two shanks has a constant width over said circumferential portion and is then continuously enlarged over the remaining part of the circumference.

Still another object of the invention is to provide an annular wall partly closing the side of the impeller turned to the motor and improving the pressure conditions to further minimize the energy losses.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
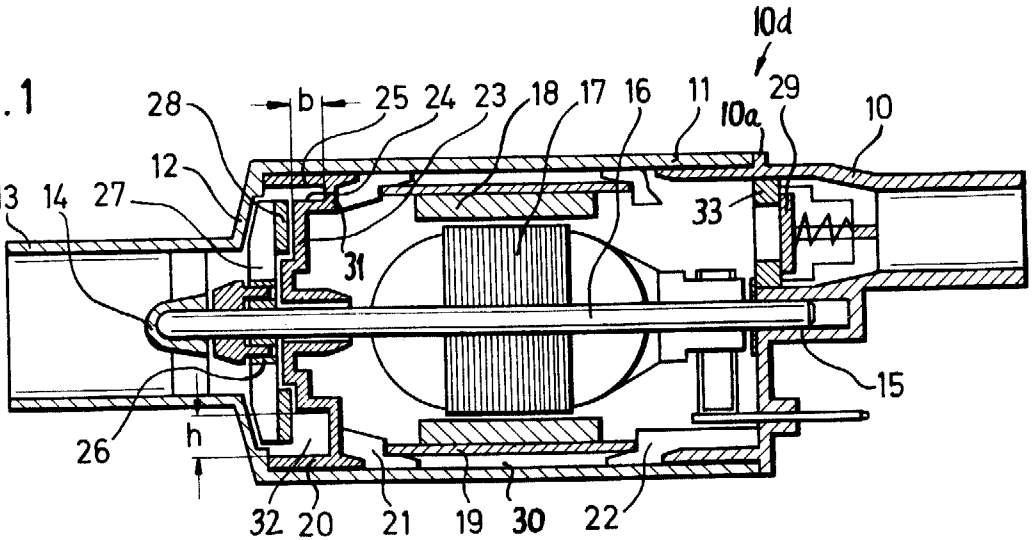
FIG. 1 is a section through a fuel pump.

Referring to the drawings in particular, the invention embodied therein, comprises a fuel pump which may be used as a gasoline pump in motor vehicles. The pump comprises an open ended first tubular housing part 10 engaged within an oppositely facing open ended second tubular housing part 11. The second housing part 11 abuts against a collar 10*a* of the first housing part 10 and is secured thereto. The first part 11 tapers at its other end forming a frusto conical portion 12 and it terminates in a tubular extension 13. Extension 13 and first housing part 10 carry respective bearings 14 and 15, in which an armature shaft 16 of an electric motor is mounted. Shaft 16 carries an armature 17 and an armature winding.

The magnetic system of the electric motor comprises a plurality of magnets 18 secured to magnet supports 19. An annular duct body 20 is supported in the second housing part 11 and is provided on the side facing armature 17 with struts or ribs 21 extending in the longitudinal direction of the armature shaft. The housing member 10 is also provided with similar struts or ribs 22. The magnet supports 19, together with their magnets 18, are secured between ribs 21 and 22 in such a manner than an annular gap 30 remains between the magnet supports 19 and the housing member 11.

An annular duct body 20 includes a plate portion 23 which is ring-shaped and concentric relative to armature shaft 16. Spaced walls 24 and 25 of the duct body define a U-shaped portion which adjoins the outer edge of the plate portion 23. The plate portion 23 terminates at one wall 24 at right angles thereto. The other wall 25 is of a greater length than wall 24. Cross-wall 31, between walls 24 and 25, is provided with apertures (not shown) for the passage of fuel. Ribs 21 are mounted at the level of these apertures, i.e., on cross-wall 31.

The length of wall 24 is measured from the end thereof to the inside of the cross-piece and is indicated by $b$, while the space between the two walls 24 and 25 is indicated by $h$. An annular duct 32, formed by the body 20, has a special shape defined by the values $b$ and $h$, as will be explained in greater detail hereinafter.

An impeller 26 is mounted on armature shaft 16 close to the conical housing portion 12 and it has radially extending blades 27. The side of impeller 26 remote from the armature 17 is partly covered by the conical housing portion 12. On the side adjacent armature 17, blades 27 are provided at their ends with an annular wall 28 located perpendicularly to armature shaft 16 so that they form a cover for the impeller. Annular wall 28 prevents a return flow from the annular duct 32 to the impeller 26. High pressure cannot build up behind the blades 27, and the axial thrust is kept low.

A valve 29 is provided in a flange fitting 33 of the housing member 10 which also carries the electrical connections for the electric motor.

Figure 2:
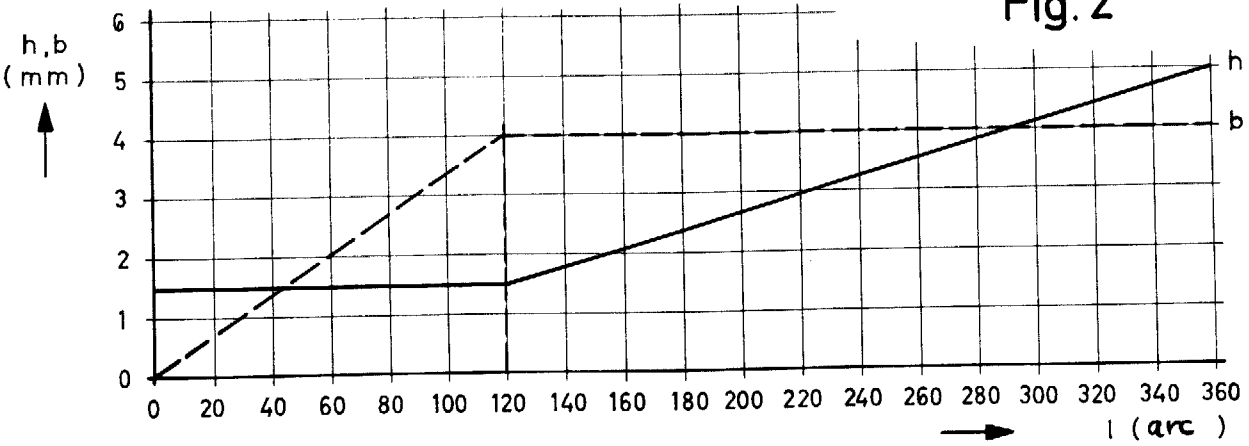
FIG. 2. shows the geometrical ratios of an annular duct formed by an annular duct body.

The arcuate variations of dimensions of the annular duct 32 and the bounding walls 24 and 25 of body 20 are shown graphically in FIG. 2. As shown in FIG. 2, the values $b$ and $h$ change dependently on the peripheral angle. The value $b$, shown in dotted lines, which represents the length of the wall 24, is calculated so that it increases over a comparatively small part, preferably 120°, of the circumference of the annular duct body from zero to a final value and then remains constant. The value $h$, which represents the dimension of wall 31 or space between the two walls 24 and 25, is calculated so that it has a minimum value over a small part (120°) of the circumference and then increases to a maximum value over the remainder of the circumference.

Fuel is circulated by the impeller 26. In view of the compact construction, it is necessary to ensure that losses remain low despite the existence of large spacing between components. Also, since it is important that impeller 26 should not warp during manufacture, it cannot be designed as narrow as would be necessary for optimal operation. For this reason, the relatively wide impeller is concentrically covered as much as is necessary.

In operation, fuel leaves the impeller at a high peripheral speed. The high speed of the fuel is decreased in the annular duct while losses of kinetic energy are kept small. The special shape of the annular duct ensures that these losses are very low. Such an annular duct enables the delivery pump to have a small diameter, or the impeller is preferably designed to have a low speed of rotation on account of the delivery. The fuel rotates in the motor chamber in the direction of rotation of the electric motor. The ribs 21 guide the major part of the flow between the magnetic system and the housing member 11, so that the armature 17 remains unimpeded to a considerably extent.

While a specific embodiment of the invention has been shown and described in detail to illustrate the application of the principles of the invention, it will be understood that the invention may be embodied otherwise without departing from such principles.

What is claimed is:

1. A pump for liquids comprising a tubular housing having an inlet and an outlet spaced from said inlet with an intermediate portion located therebetween, said housing having a tapered portion adjacent the inlet and connecting the inlet to said intermediate portion, an electric motor mounted concentrically in said housing and including an armature shaft and a magnetic system, an impeller mounted in said housing on said armature shaft for rotation therewith and having radially extending blades closely adjacent said tapered portion of said housing and adapted, in operation, to take up and guide the liquid toward the circumference of said impeller, and wall means forming an annular radially and longitudinally extending duct adjacent the circumference of said impeller on the side thereof facing said electric motor and shaped to guide the liquid with minimum losses of energy, said means for forming an annular duct comprise an annular duct body which is supported in said housing adjacent the side of said impeller remote from said tapered portion and including an annular plate portion concentrically arranged relative to said armature shaft and terminating in an outer edge, and a duct portion extending along and adjoining said outer edge and having a U-shaped cross-section defined by first and second longitudinally extending wall portions of said duct portion and a radially extending cross-wall therebetween, said plate portion joining the end of said first wall portion of said U-shaped portion at right angles, said second wall portion of said U-shaped portion being of greater length than said first wall portion, and said connecting cross-wall between said two walls being provided with apertures for the liquid, the length of said first shank from the end of said first wall portion to the inside of said connecting crosspiece is such that it increases in longitudinal depth over a comparatively small portion of the circumference of said annular duct body from zero to an end value, and the space of said two wall portions is such that it has a minimum value over the said portion of the circumference and then increases to a maximum value over the remaining part of said circumference.

2. A pump for liquids, as claimed in claim 1, wherein said small portion of said circumference amounts to 120°.

3. A pump for liquids, as claimed in claim 1, wherein said annular duct body is provided, on the side remote from said tapered portion of said housing, with struts extending in longitudinal direction of and spaced from said housing and mounted, by their one ends, on said cross-wall of said duct body and supporting, by their free ends, said magnetic system of said electric motor in such a manner that the liquid may be conveyed between said magnetic system and said housing.

* * * * *